US011420811B2

(12) United States Patent
Teitelbaum

(10) Patent No.: US 11,420,811 B2
(45) Date of Patent: Aug. 23, 2022

(54) COLLAR SUPPORT STRAP FOR SHIRT PACKAGING

(71) Applicant: R-PAC INTERNATIONAL CORP., New York City, NY (US)

(72) Inventor: Michael Teitelbaum, New York City, NY (US)

(73) Assignee: r-pac International Corp., New York, NY (US)

( * ) Notice: Subject to any disclaimer, the term of this patent is extended or adjusted under 35 U.S.C. 154(b) by 0 days.

(21) Appl. No.: 16/517,856

(22) Filed: Jul. 22, 2019

(65) Prior Publication Data

US 2020/0369459 A1 Nov. 26, 2020

Related U.S. Application Data

(60) Provisional application No. 62/851,159, filed on May 22, 2019.

(51) Int. Cl.
*B65D 85/18* (2006.01)

(52) U.S. Cl.
CPC ..... *B65D 85/182* (2013.01)

(58) Field of Classification Search
CPC ..... A41B 1/14; A41B 3/06; B65D 85/182; B65D 63/1018; B65B 25/20; D06F 59/02; Y10T 24/1406; Y10T 24/1498
USPC ..... 223/83; 206/278, 292; 229/87.17
See application file for complete search history.

(56) References Cited

U.S. PATENT DOCUMENTS

| | | | | |
|---|---|---|---|---|
| 3,760,994 | A * | 9/1973 | Taimisto | A47F 7/12 223/83 |
| 4,133,463 | A | 1/1979 | Bourrian | |
| 4,798,293 | A | 1/1989 | Carstens | |
| 5,316,139 | A | 5/1994 | Judd et al. | |
| 6,889,387 | B1 | 5/2005 | Tiss et al. | |
| 7,310,857 | B2 * | 12/2007 | Kim | B65D 63/1018 24/16 PB |
| 8,769,914 | B2 | 7/2014 | Pape | |
| 9,307,791 | B2 | 4/2016 | Garcia | |
| 9,622,512 | B2 | 4/2017 | Partsch, IV | |
| 2013/0042392 | A1 * | 2/2013 | Ostrow | A41B 1/14 2/258 |

FOREIGN PATENT DOCUMENTS

| | | | | |
|---|---|---|---|---|
| GB | 904809 | A * | 8/1962 | B65D 85/182 |

* cited by examiner

*Primary Examiner* — F Griffin Hall
(74) *Attorney, Agent, or Firm* — Levenfeld Pearlstein, LLC

(57) ABSTRACT

A single piece of collar support strap to package collar portion of a shirt is described. Shirt collars are traditionally packaged in a way to reflect the collar's positioning and shape in actual use. Conventional methods employ multiple pieces of support items placed in different locations. A collar support strap provides the positioning of the collar in a packaged shirt not only through a single piece item, but also provides ease of packaging by avoiding multiple steps of operations to package the shirt. The collar support strap enables adjustment to varying collar sizes, anchoring to the collar button, and accommodation of the different collar types.

16 Claims, 10 Drawing Sheets

-Prior Art -

-Prior Art-

COLLAR SUPPORT STRAP FOR SHIRT PACKAGING

BACKGROUND

Unless otherwise indicated herein, the materials described in this section are not prior art to the claims in this application and are not admitted to be prior art by inclusion in this section.

Global garment industry is valued approximately at $278 billion while the US garment industry is estimated to be worth $45 billion. In large segments of the garment industry profit margins are small, that is, cost of manufacturing, packaging, and shipping are important aspects to manage. Even small reductions in manufacturing, packaging, and shipping costs may impact profits, and thereby, survivability of an industry segment. Conventional packaging of dress shirts typically includes packing of each shirt individually in a flat rectangular plastic or similar bags or boxes.

For appealing presentation and out-of-the-box use, each shirt is folded into rectangular form on a sheet of flexible cardboard or similar material, and the shirt collar is supported by a collar board interposed between the collar and the collar band, frequently with additional collar stays and supports at the front of the collar. The collar board may be a folded portion of the shirt board. To maintain the integrity of the folded shirt package, mechanical fasteners such as pins or clips may also be used. The shirt packaging process, typically including folding, fastening, and so on, is a complex operation, generally performed manually and involving a number of different steps. In case of manual labor, considerable skill, experience, and coordination may be needed. Considering the pressures to keep cost of packaging low, the conventional packaging approaches present challenges to the economics of garment industry. Thus, there is an existing and continued need for improvements in manufacture, packaging, and shipping of garments.

SUMMARY

The present disclosure generally describes collar support strap for shirt packaging.

According to some embodiments, a single piece of collar support strap may be used to package collar portion of a shirt. Shirt collars are traditionally packaged in a way to reflect the collar's positioning and shape in actual use. Conventional methods employ multiple pieces of support items placed in different locations. A collar support strap provides the positioning of the collar in a packaged shirt not only through a single piece item, but also provides ease of packaging by avoiding multiple steps of operations to package the shirt. The collar support strap enables adjustment to varying collar sizes, anchoring to the collar button, and accommodation of the different collar types.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The foregoing and other features of this disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings, in which:

DETAILED DESCRIPTION

Figure 1A:
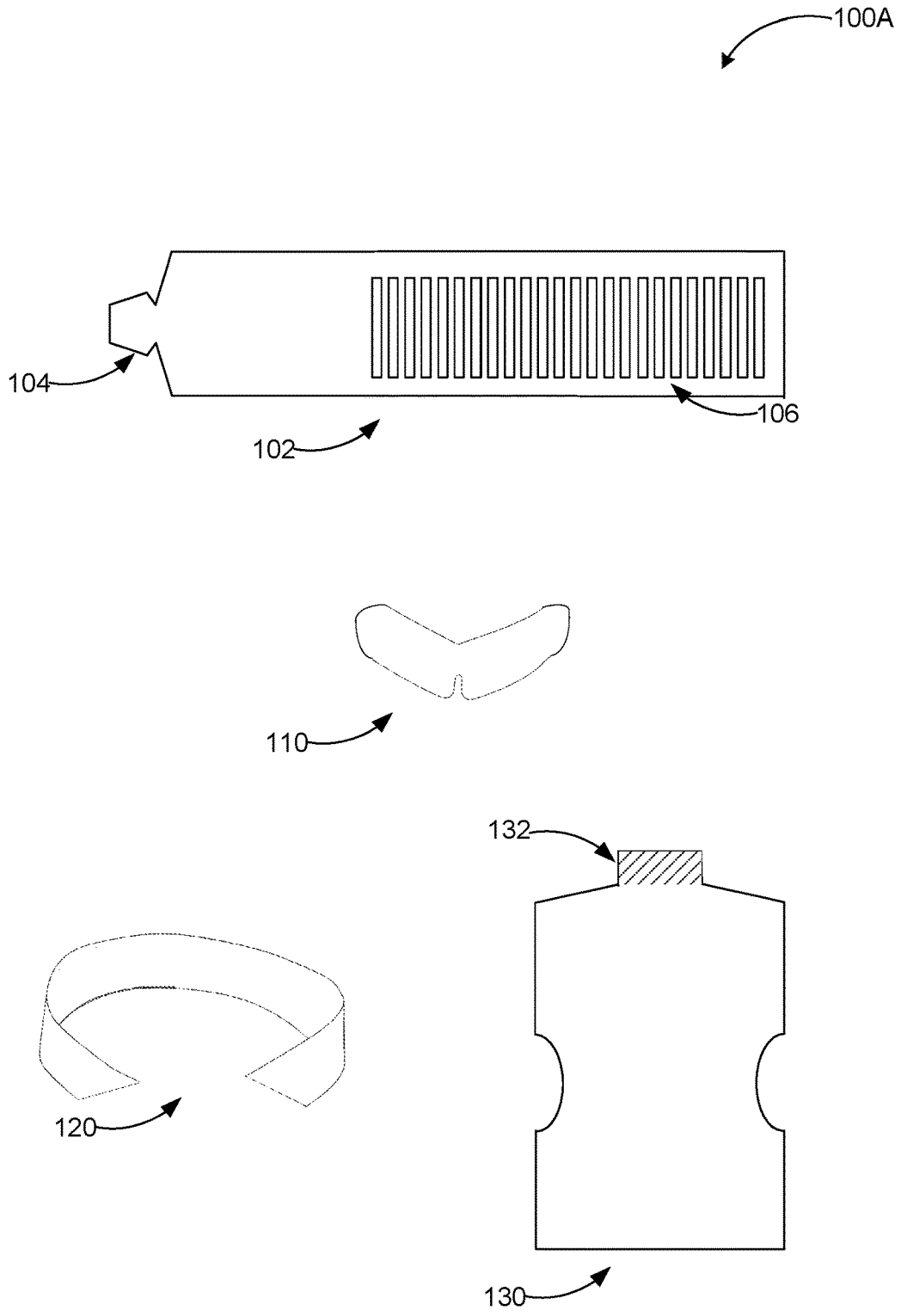
FIG. 1A includes illustrations of shirt collar support materials for conventional dress shirt packaging.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

This disclosure is generally drawn, inter alia, to methods and apparatus related to providing collar support for shirt packaging.

Briefly stated, technologies are generally described to provide a single piece of collar support strap to package collar portion of a shirt. Shirt collars are traditionally packaged in a way to reflect the collar's positioning and shape in actual use. Conventional methods employ multiple pieces of support items placed in different locations. A collar support strap provides the positioning of the collar in a packaged shirt not only through a single piece item, but also provides ease of packaging by avoiding multiple steps of operations to package the shirt. The collar support strap enables adjustment to varying collar sizes, anchoring to the collar button, and accommodation of the different collar types.

FIG. 1A includes illustrations of shirt collar support materials for conventional dress shirt packaging.

Conventional packaging of dress shirts typically includes packing of each shirt individually in a flat rectangular plastic or similar bags or boxes. For appealing presentation and out-of-the-box use, each shirt is folded into rectangular form on a sheet of flexible cardboard or similar material, and the shirt collar is supported by a collar board interposed between the collar and the collar band, frequently with additional collar stays and supports at the front of the collar. The collar board may be a folded portion of the shirt board. To maintain the integrity of the folded shirt package, mechanical fasteners such as pins or clips may also be used. The support pieces may allow the collar to be in a similar position to actual use and the shirt to be used upon opening of the packaging without special treatment of the collar such as ironing, buttoning, starching, etc. The shirt packaging process, typically including folding, fastening, and so on, is a complex operation, generally performed manually and involving a number of different steps. Furthermore, post-sale unpacking of a shirt, packaged according to conventional approaches, by a consumer may also be time consuming, involving, location and removal of all the fasteners and collar support material. Environmental concerns may also play a role with the multitude of packaging support pieces.

As shown in diagram 100A, example shirt collar support materials may include an inside strap 102, a collar button support piece 110, a collar stay 120, and a shirt board 130. The inside strap 102, the collar button support piece 110, the collar stay 120, and the shirt board 130 may be made from paper, cardboard, plastic, and similar materials. The inside strap 102 may be placed inside the collar of a packaged shirt and provide support to keep the collar in form. The inside strap 102 may be adjustable in length through a one tongue (104)/multiple grooves (106) system to accommodate different collar sizes.

The collar button support piece 110 may be placed around the collar button and provide support to the collar points to keep them in form. The collar stay 120 may be interposed between the collar and the collar band for further support to keep the collar in form. In some cases, the collar stay 120 may comprise multiple pieces. The shirt board 130 may help prevent the packaged shirt from folding or creasing in packaged form. A portion of the shirt board 130, the collar board 132 may be folded perpendicularly from a plane of the shirt board 130 and tucked inside the folded portion of the collar (between the collar and the collar band) to provide further support to keep the collar in form, as well as, anchor the shirt board 130 to the collar.

Figure 1B:
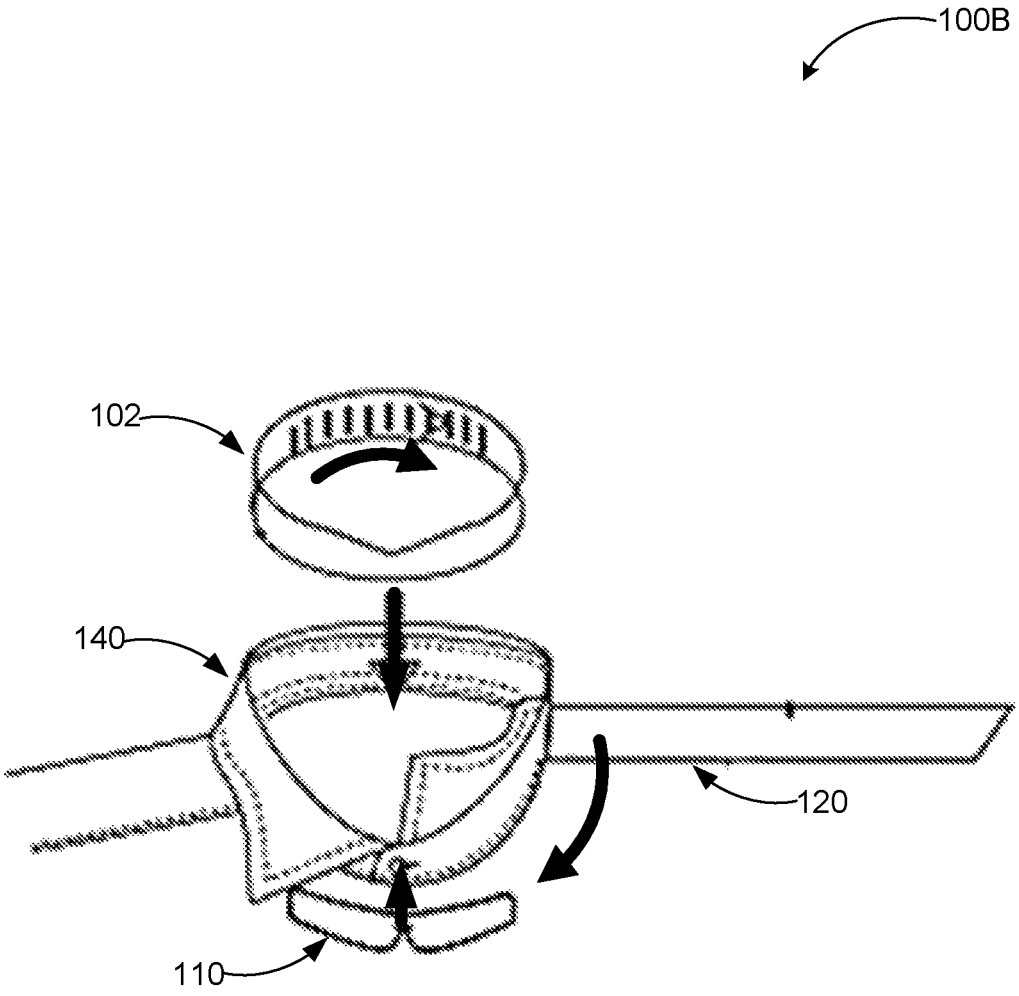
FIG. 1B includes an illustration of shirt collar support for conventional dress shirt packaging.

FIG. 1B includes an illustration of shirt collar support for conventional dress shirt packaging.

Packaging a shirt using the conventional support pieces described above typically requires multiple distinct operations. Example operations, shown in diagram 100B, may include coupling of the inside strap 102 to size, unfolding of the shirt collar 140, placement of the collar board 134 (not shown) and placement of the collar stay 120 around the collar band, placement of the collar button support piece 110 on the collar button, and folding of the shirt collar 140 in form over the collar band and the support pieces. The support pieces may help keep the collar upright and prevent folding. As discussed above, these are typically manual operations requiring additional man/woman hours for packaging the shirts and increasing cost of packaged shirts.

Figure 2:
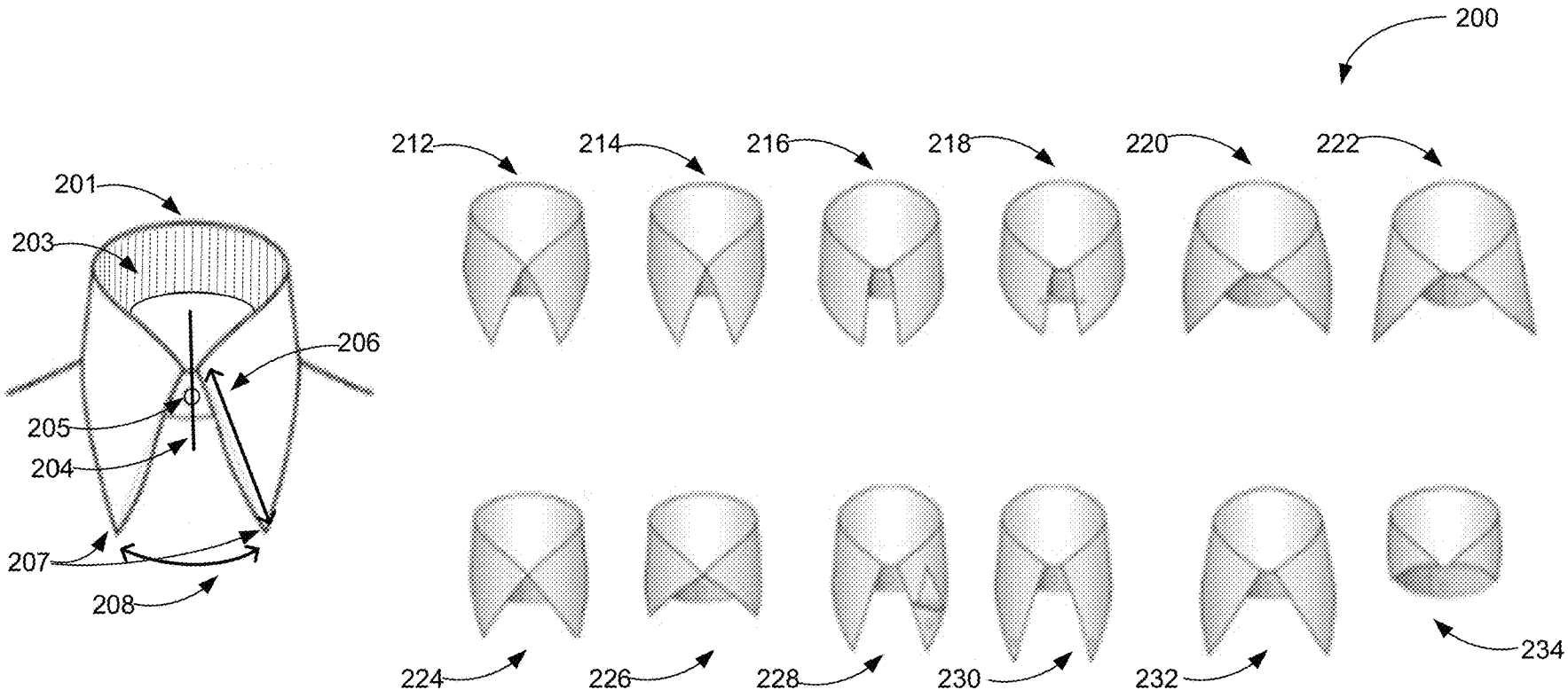
FIG. 2 illustrates different shirt collar types.

FIG. 2 illustrates different shirt collar types.

Diagram 200 shows a shirt collar 201 folded over a collar band 203. The collar 201 includes two collar points 207. The collar band 203 is connected in the front by a collar button 205. Parameters that define types of shirt collars include center front 204, point length 206, and collar spread 208.

Different collar types may include, but are not limited to, classic collar 212, standard collar 214, tab collar 216, eyelet collar 218, Italian spread collar 220, British spread collar 222, semi-spread collar 224, spread collar 226, hidden button collar 228, button down collar 230, 2-button collar band collar 232, and wing tip collar 234. The collar is connected to the yoke (shoulders) of the shirt through the collar band. For packaging purposes, a type of collar may also require different types/sizes/shapes of collar support pieces, in addition to the collar size.

Figure 3A:
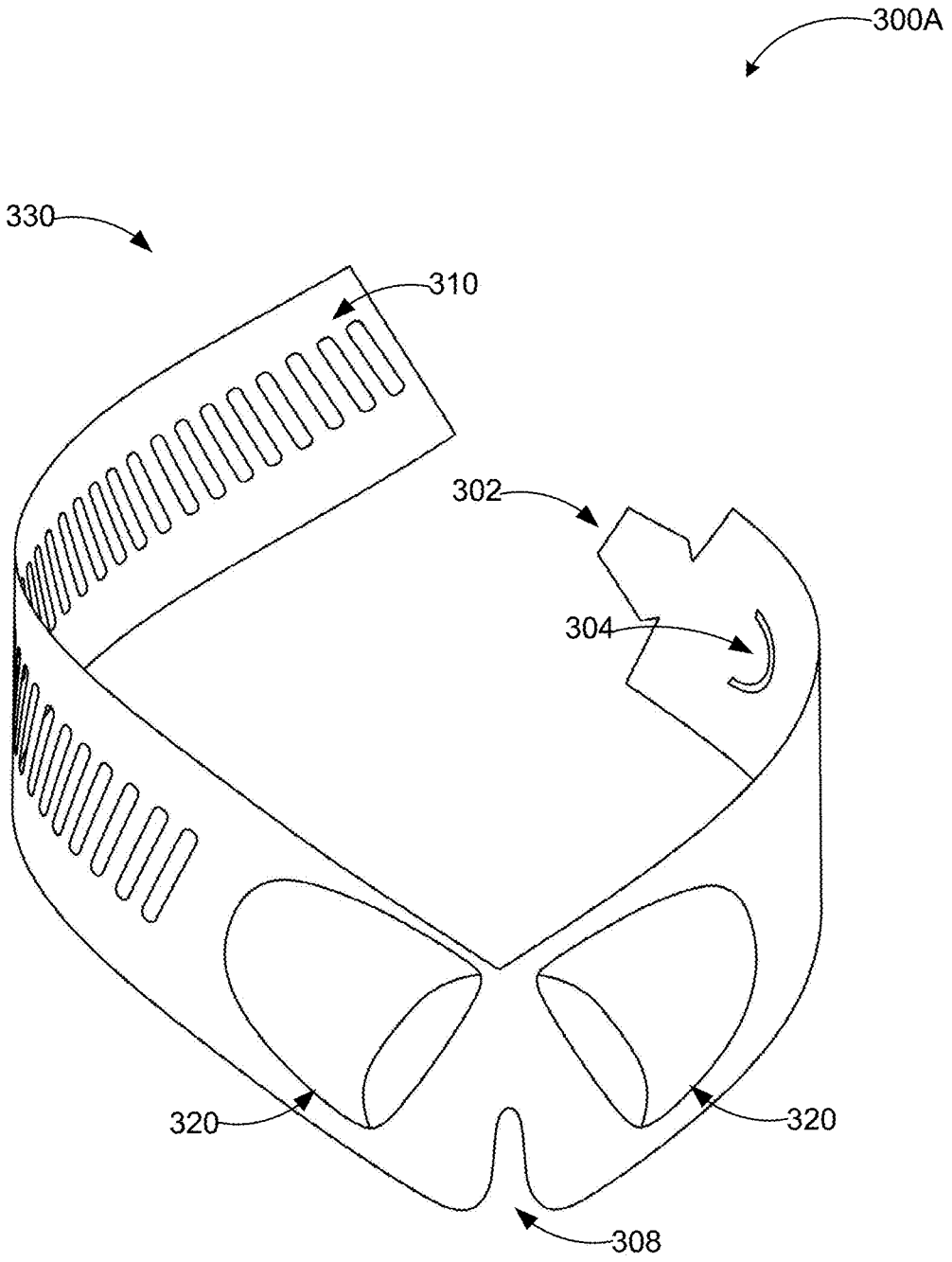
FIGS. 3A and 3B includes illustrations of different configurations of an example shirt collar support strap according to some embodiments.
Figure 3B:
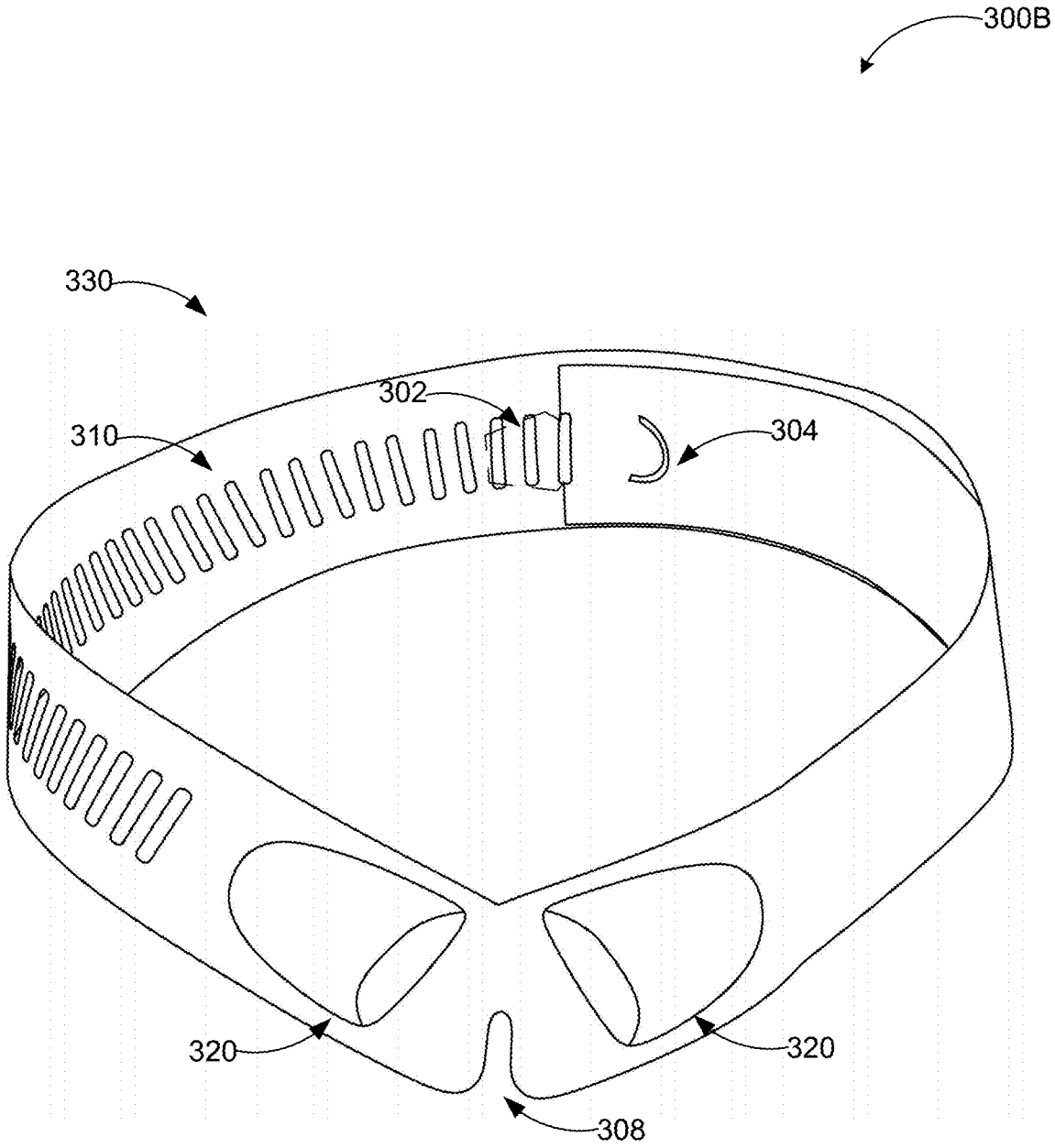

FIGS. 3A and 3B includes illustrations of different configurations of an example shirt collar support strap according to some embodiments.

Diagram 300A shows a partially formed collar support strap 330. In a manufacturing environment, different sizes of collar support straps may be pre-locked to selected sizes (depending on collar sizes and types of the manufactured shirts). Depending on the manufactured shirts, different widths of straps and different angles of straps may also be prepared for packaging beforehand. At a packaging station, a collar of a shirt may be folded up, the pre-formed strap placed around the collar band anchoring the strap to the collar button, and the collar may be folded down keeping its form thanks to the collar support strap.

Collar support strap 330 may be selected based on its width and angle for a particular type of collar. The partially formed (twisted) collar support strap 330 includes grooves 310 and tongue 302 as primary locking mechanism, secondary locking mechanism 304, anchoring cutout 308, and protrusions ("bubbles") 320.

Diagram 300B shows the collar support strap 330 in fully formed (locked) configuration. In fully formed configuration, the tongue 302 may be inserted into a selected one of the grooves 310 depending on the size of the collar. Optionally, the tongue of the secondary locking mechanism 304 may be inserted into another one of the grooves for further strength of the locking.

Figure 4A:
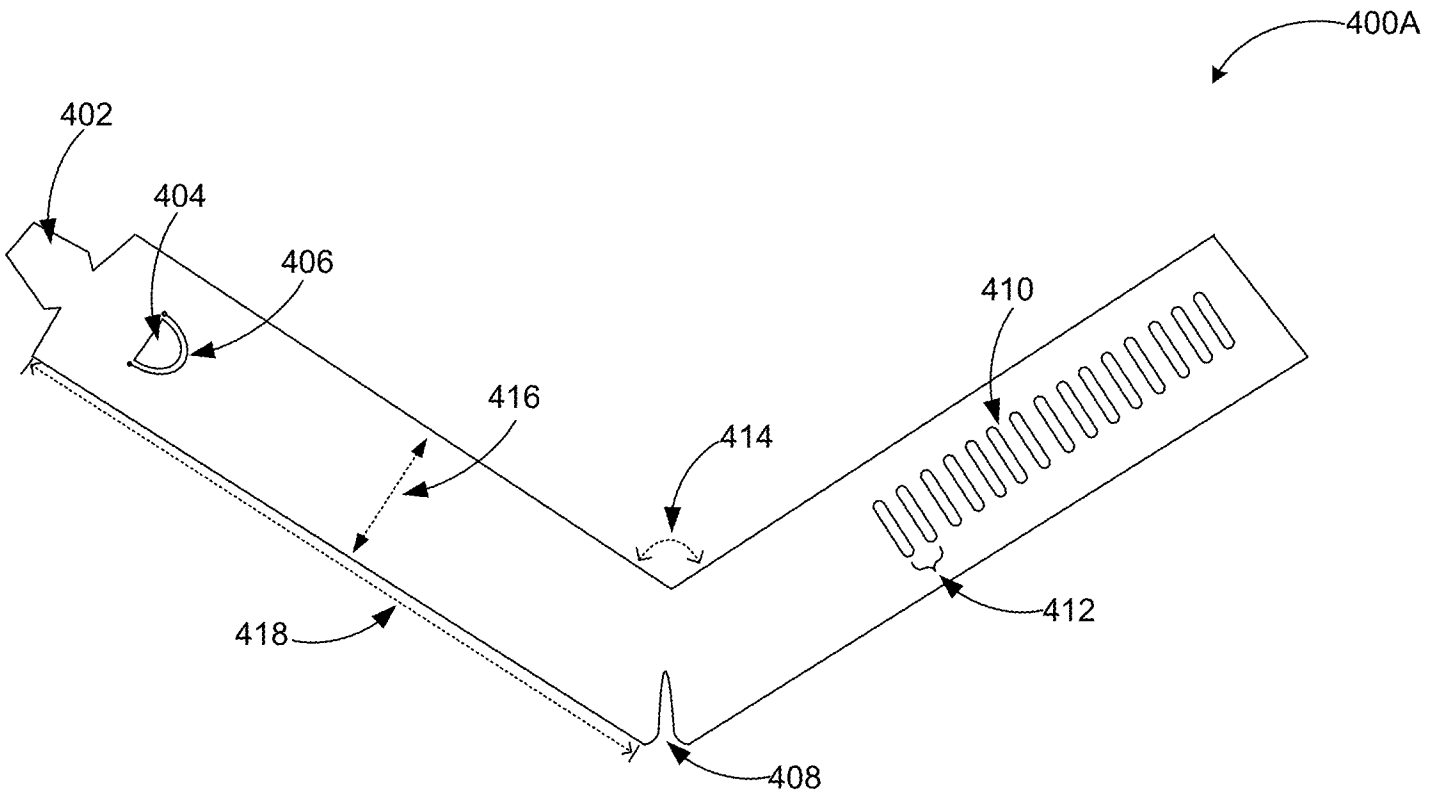
FIGS. 4A and 4B illustrate example shirt collar support straps for packaging according to some embodiments.
Figure 4B:
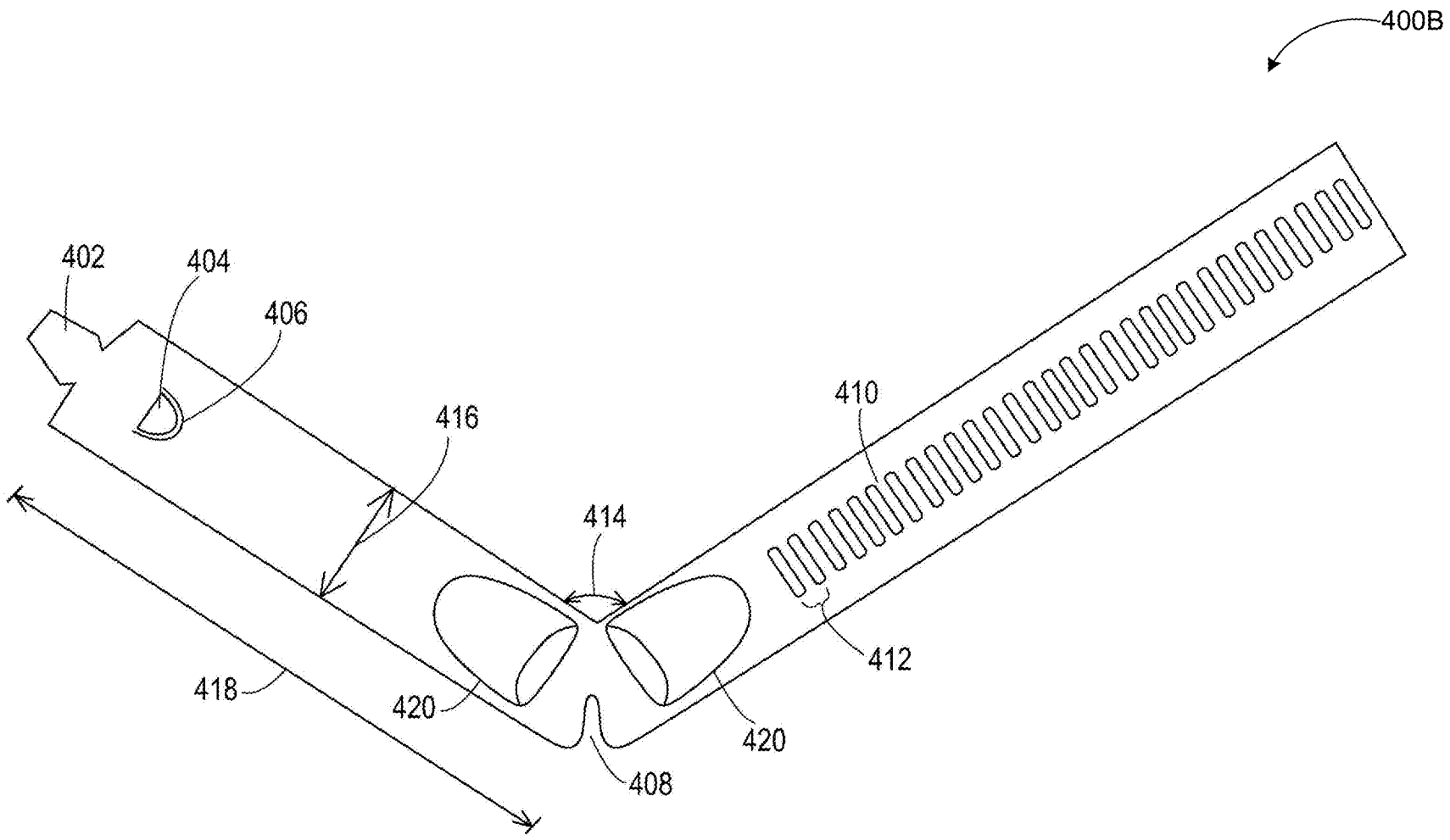

FIGS. 4A and 4B illustrate example shirt collar support straps for packaging according to some embodiments.

Diagram 400A shows a single collar support strap that may be used to support collars in packaging and be placed on the shirt to be packaged in a single operation. A shape of the collar support strap may be defined by its length 418, angle 414, and width 416. The width 416 may be in discrete steps for different types of collar with varying height (e.g., 1", 1.5", 2", etc.). The angle 414 may also be in discrete values (180 deg, 170 deg., 160 deg, 150 deg, etc.) depending on the collar type. Of course, other values may be selected for different strap forms. The length 418 of the strap may be selected to accommodate a largest collar size and then the actual size of the formed strap may be adjusted down to accommodate smaller size collars by using the tongue and groove system. In the tongue and groove system, the tongue element 402 may be inserted into a selected one of the grooves 410 depending on the desired size for the strap. A distance 412 between the grooves 410 may be selected based on a desired increment to adjust the size of the strap (e.g., 0.2", 0.4", 0.6", etc.).

Optionally, a secondary locking mechanism may be employed in the collar support strap to ensure that the strap maintains its selected size. The secondary locking mechanism may include a tongue 404 within a cutout 406, where the tongue 404 may be pushed out of the plane of the strap slightly and fitted into a second groove of the grooves 410. The original tongue and groove system may not always stay locked (the tongue may slip out of the selected groove), but the secondary locking mechanism may ensure the collar support strap maintains its size and form once locked in place. The collar support strap may also include a cutout 408 at an apex. The cutout 408 may be used to push the strap around the collar button and anchor the strap to the collar button.

Diagram 400B shows another collar support strap with similar elements and configuration as the strap of FIG. 4A. The collar support strap in FIG. 4B has two additional elements, protrusions ("bubbles") 420 in a vicinity of the cutout 408 to provide support to the collar points and keep the collar in form. By lifting the collar (the portion near the collar points) from the collar band, the bubbles 420 may also provide an esthetically appealing look to the shirt when packaged. A size and depth of the bubbles 420 may be selected based on a type of collar (for example, deeper and larger bubbles for larger collar points).

Figure 5:
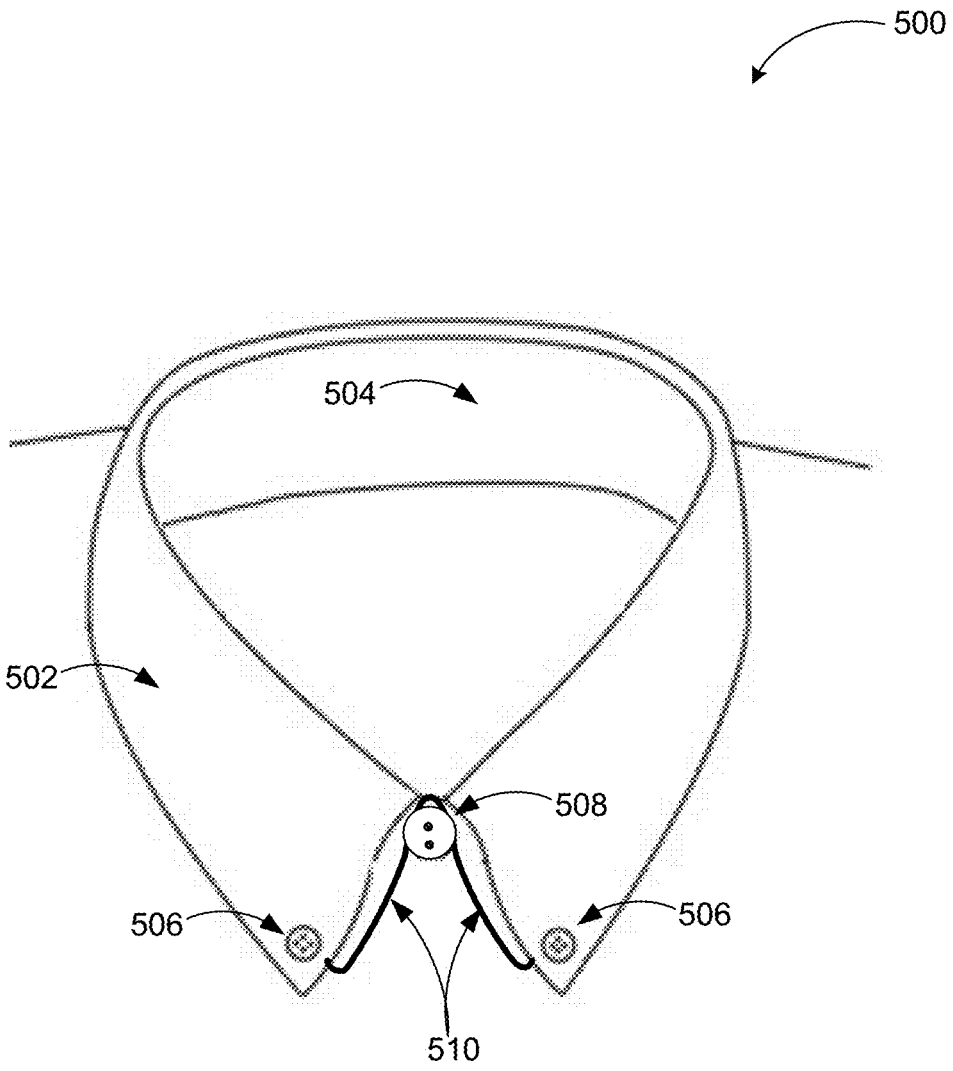
FIG. 5 illustrates a shirt collar with a support strap in place in accordance with at least some embodiments.

FIG. 5 illustrates a shirt collar with a support strap in place in accordance with at least some embodiments.

As shown in diagram 500, a collar support strap 510 may be placed inside the folding between the collar 502 and collar band 504 anchored to the collar button 508. The collar 502 may be fastened to the yoke through buttons 506 in some examples. Thus, the collar support strap 510 may be largely (or completely) invisible to a purchaser while keeping the collar in form in the packaging rendering the packaged shirt esthetically more appealing while not distracting a consumer from the look and feel of the packaged shirt.

Design parameters of the collar support strap 510 to fit different types, sizes, and heights of collars may include length of the strap, width of the strap, angle of the strap, number and distance of the grooves in the tongue and groove locking mechanism. In some examples the collar support strap 510 may include two protrusions ("bubbles") to lift the collar from the collar band. Furthermore, a depth of the cutout of the collar support strap 510 may be designed for optimal fit of the strap on the button and inside the collar. The collar support strap 510 may be made from materials such as paper, cardboard, plastic, polyethylene, recyclable materials, recycled materials, and similar ones. As discussed above, pre-formed straps may be incorporated into shirts in a single operation during packaging.

Figure 6:
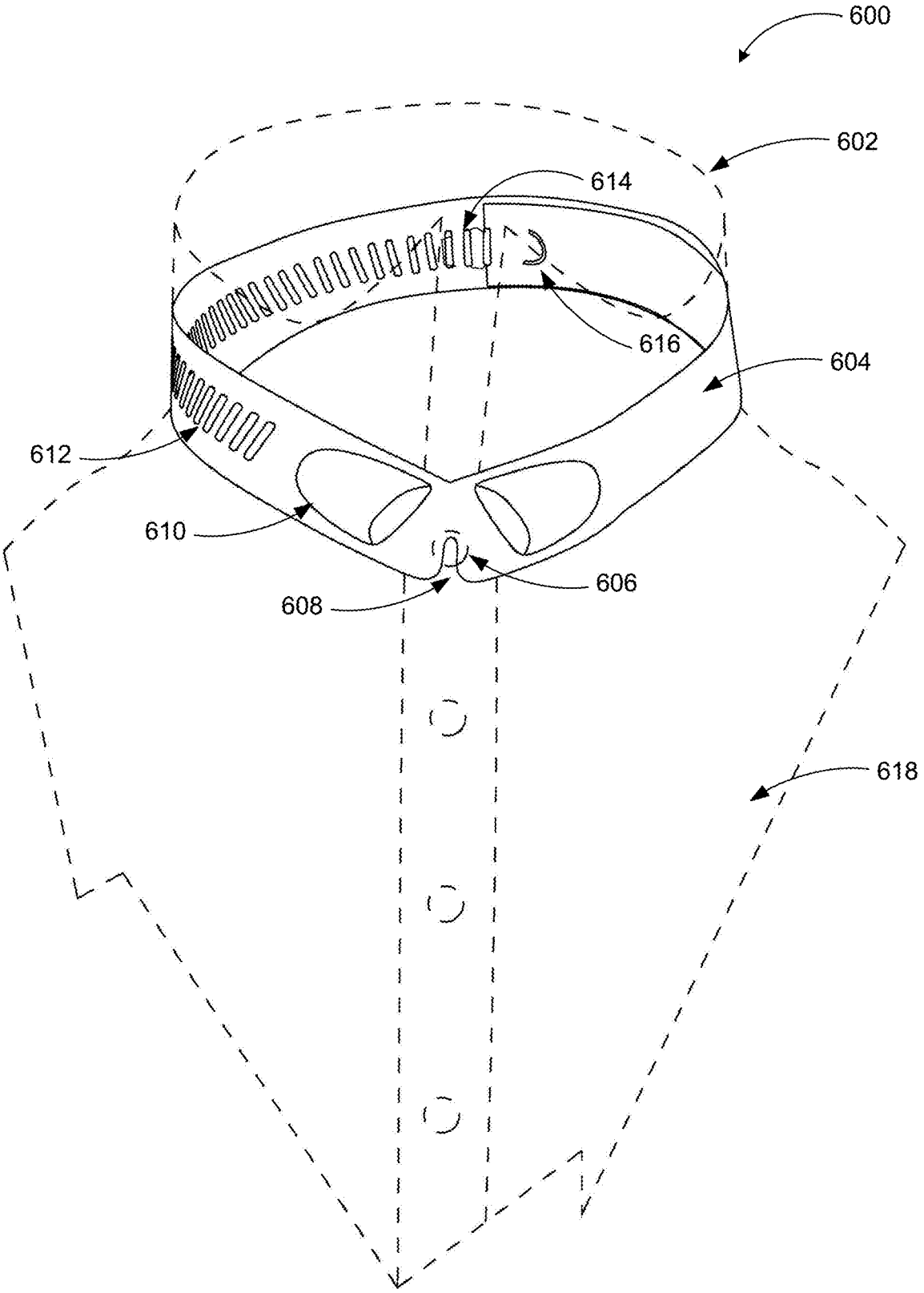
FIG. 6 illustrates placement of an example support strap according to embodiments in a shirt collar during packaging.

FIG. 6 illustrates placement of an example support strap according to embodiments in a shirt collar during packaging.

As shown in diagram 600, a formed shirt includes a shirt body 618, a collar 602, collar band (not shown), and a collar button 606, among other things. A collar support strap 604 may be locked using a suitable one of the grooves 612 and the tongue 614 (and optionally using second tongue 616 and another one of the grooves) according to a size of the collar 602. The locked collar support strap 604 may be placed around the collar band (on an outside surface of the collar band 606) over the unfolded collar 602. The bubbles 610 of the collar support strap 604 may provide to lift the collar 602 from the collar band and provide a realistic form when the shirt is packaged. Cutout 608 may be used to anchor the collar support strap 604 to the shirt through the collar button 606.

In some examples, pre-formed collar support straps for different size collars may be stocked at a manufacturing facility. Thus, the collar treatment portion of shirt packaging process may simply include unfolding of the collar, sliding of a pre-formed collar support strap over the unfolded collar, and folding of the collar. In addition to reduction of the number of support pieces and their placement, the collar support strap 604 may be largely invisible in the packaged shirt and not distract a purchaser from the shirt itself. Furthermore, unpacking the shirt may be made easier through the use of the single support piece and a number of packaging items to be discarded may be reduced helping the environment.

Figure 7:
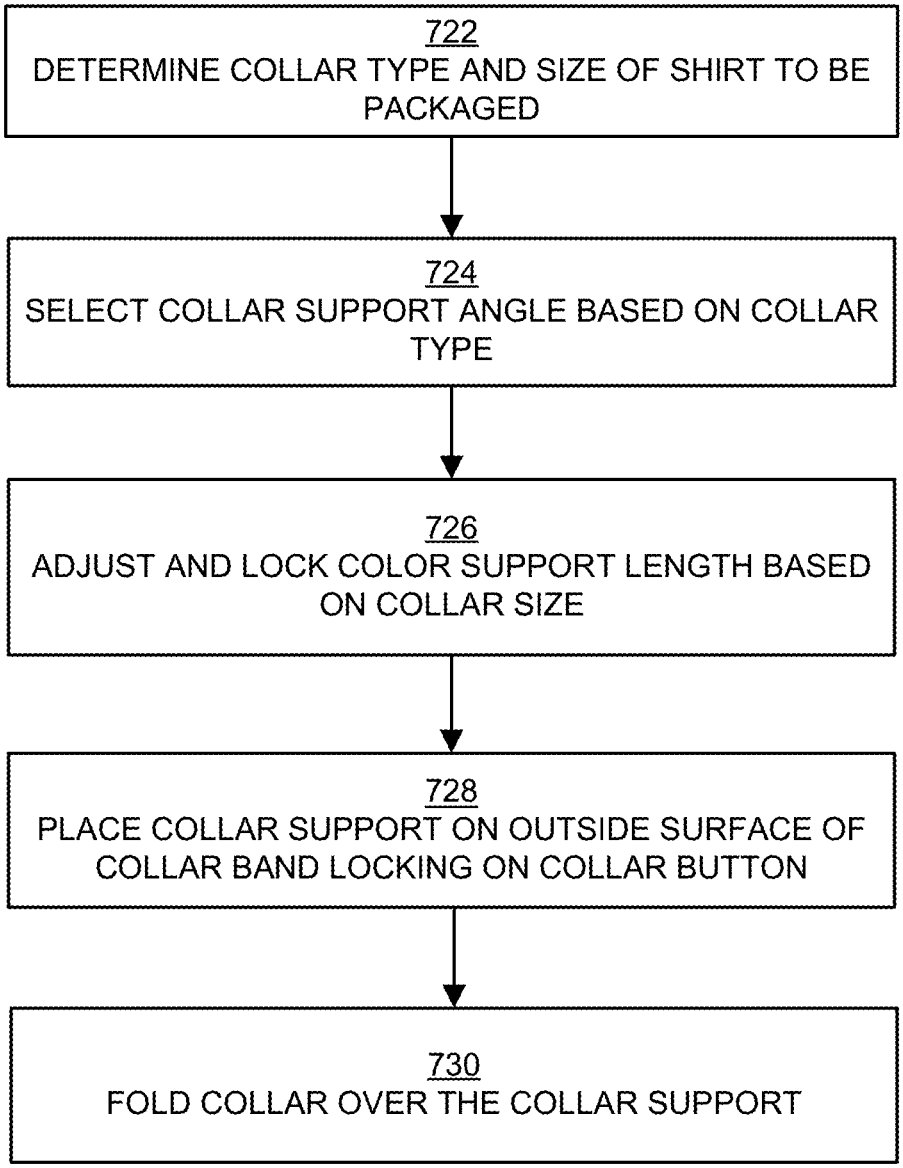
FIG. 7 illustrates a block diagram of an example method for providing collar support for shirt packaging arranged in accordance with at least some embodiments described herein.

FIG. 7 illustrates a block diagram of an example method for providing collar support for shirt packaging arranged in accordance with at least some embodiments described herein.

Example methods may include one or more operations, functions or actions as illustrated by one or more of blocks 722, 724, 726, 728, 730, and may in some embodiments be performed by human beings or an automated packaging machine. The operations described in the blocks 722-730 may also be stored as computer-executable instructions in a computer-readable medium to be executed by a controller (computing device) to control operations of an automated packaging machine.

An example process to provide collar support for shirt packaging may begin with block 722, "DETERMINE COLLAR TYPE AND SIZE OF SHIRT TO BE PACKAGED", where collar type, height, and size of a shirt to be packaged may be determined by user input, reading a shirt label, measuring a shirt, etc.

Block 722 may be followed by block 724, "SELECT COLLAR SUPPORT STRAP ANGLE BASED ON COLLAR TYPE", where a collar support strap of a particular angle may be selected for the shirt to be packaged. While not separately shown, a width of the collar support strap may also be selected based on a height of the collar of the shirt to be packaged.

Block 724 may be followed by block 726, "ADJUST AND LOCK COLOR SUPPORT STRAP LENGTH BASED ON COLLAR SIZE", where a length of the collar support strap may be adjusted by selecting one of the grooves on the collar support strap and locking the tongue of the primary locking mechanism to the selected groove. Optionally, the secondary locking mechanism may also be engaged providing additional locking support.

Block 726 may be followed by block 728, "PLACE COLLAR SUPPORT STRAP ON OUTSIDE SURFACE OF COLLAR BAND ANCHORING TO COLLAR BUTTON", where the selected and pre-formed collar support strap may be placed on an outside surface of the collar band with the collar folded up. The strap may be anchored to the collar button by pushing the collar button into the cutout of the strap at its apex.

Block 728 may be followed by block 730, "FOLD COLLAR OVER THE COLLAR SUPPORT STRAP", where the collar may be folded over the collar support strap keeping the collar in form in the packaged shirt and keeping the collar support strap largely invisible to a purchaser.

According to some examples, a method to provide support for a shirt collar in a packaged form is described. The method may include selecting a pre-formed collar support strap based on one of more of a collar size, a collar type, and a collar height; unfolding the shirt collar over a collar band; placing the selected collar support strap on an outside surface of the collar band; anchoring the collar support strap to a collar button; and folding the shirt collar over the collar support strap.

According to other examples, selecting the pre-formed collar support strap based on one of more of the collar size, the collar type, and the collar height may include selecting a width of the collar support strap based on the collar height. Selecting the pre-formed collar support strap based on one of more of the collar size, the collar type, and the collar height may include selecting an angle of the collar support strap based on the collar type. Selecting the pre-formed collar support strap based on one of more of the collar size, the collar type, and the collar height may include selecting a length of the collar support strap based on the collar size. Selecting the length of the collar support strap based on the collar size may include selecting and locking a tongue and groove based locking mechanism of the collar support strap based on the selected length. Selecting the length of the collar support strap based on the collar size further may include locking a second locking mechanism of the collar support strap. The second locking mechanism may include another tongue and a cutout to push the other tongue into another selected groove. Anchoring the collar support strap to the collar button may include pushing the collar button into a cutout at an apex of the collar support strap. The collar support strap may be made from a material including a paper, a cardboard, a plastic, a polyethylene, a recyclable material, or a recycled material.

According to further examples, a collar support strap to provide support for a shirt collar in a packaged form is described. The collar support strap may include a substantially flat body comprising two halves at a predefined angle; a locking mechanism comprising a tongue piece protruding from a distal edge of one of the two halves and a plurality of grooves along another one of the two halves; and a cutout at an apex of the body connecting the two halves, the cutout configured to anchor the collar support strap to a collar button.

According to some examples, the collar support strap may be configured to be placed between a collar band and the shirt collar in the packaged form. The collar support strap may be substantially invisible when the shirt collar is folded over the collar support strap in the packaged form. A width of the collar support strap may be selected based on a collar height. The predefined angle of the collar support strap may be selected based on a collar type. A length of the collar support strap may be adjustable through selection of a proper groove of the plurality of grooves based on a shirt collar size and locking of the tongue piece into the selected groove.

According to other examples, the collar support strap may further include a second locking mechanism within the body of the collar support strap, where the second locking mechanism includes another tongue piece and a cutout around the other tongue piece to push the other tongue into another selected groove. The collar support strap may also include two protrusions from the body of the collar support strap in a vicinity of the cutout to provide support for collar points in the packaged form. A size and a depth of the two protrusions may be selected based on a size of the collar points. The collar support strap may be made from a material including a paper, a cardboard, a plastic, a polyethylene, a recyclable material, or a recycled material.

According to further examples, a collar support strap to provide support for a shirt collar in a packaged form is described. The collar support strap may include a substantially flat body comprising two halves at a predefined angle; a locking mechanism comprising a tongue piece protruding from a distal edge of one of the two halves and a plurality of grooves along another one of the two halves; a second locking mechanism within the body of the collar support strap, where the second locking mechanism comprises another tongue piece and a cutout around the other tongue piece to push the other tongue into another selected groove; a cutout at an apex of the body connecting the two halves, the cutout configured to anchor the collar support strap to a collar button; and two protrusions from the body of the collar support strap in a vicinity of the cutout to provide support for collar points in the packaged form.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is also to be understood that the terminology used herein is for the purpose of describing particular embodiments only and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations).

Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A method to provide support for a shirt collar in a packaged form, the method comprising:

selecting a pre-formed collar support strap based on one of more of a collar size, a collar type, and a collar height, the pre-formed collar support strap comprising:

a substantially flat body comprising two halves at a predefined angle;

a first locking mechanism comprising a first tongue piece protruding from a distal edge of one of the two halves and a plurality of grooves along another one of the two halves;

a second locking mechanism within the body of the pre-formed collar support strap when the pre-formed collar support strap is in an unfolded condition, wherein the second locking mechanism comprises a second tongue piece and a cutout around the second tongue piece to push the second tongue piece into another selected groove of the plurality of grooves, wherein the second tongue piece is positioned between the first tongue piece and the plurality of grooves when the pre-formed collar support strap is in the unfolded condition; and a cutout at an apex of the body connecting the two halves, the cutout configured to anchor the collar support strap to a collar button of the shirt collar;

unfolding the shirt collar over a collar band;

placing the selected pre-formed collar support strap on an outside surface of the collar band;

anchoring the pre-formed collar support strap at the cutout to a collar button;

locking the first and second locking mechanisms; and folding the shirt collar over the pre-formed collar support strap.

2. The method of claim 1, wherein selecting the pre-formed collar support strap based on one of more of the collar size, the collar type, and the collar height comprises:

selecting a width of the collar support strap based on the collar height.

3. The method of claim 1, wherein selecting the pre-formed collar support strap based on one of more of the collar size, the collar type, and the collar height comprises:

selecting an angle of the collar support strap based on the collar type.

4. The method of claim 1, wherein selecting the pre-formed collar support strap based on one of more of the collar size, the collar type, and the collar height comprises:

selecting a length of the collar support strap based on the collar size.

5. The method of claim 1, wherein anchoring the collar support strap to the collar button comprises pushing the collar button into the cutout at the apex of the collar support strap.

6. The method of claim 1, wherein the collar support strap is made from a material comprising one or more from the list of a paper, a cardboard, a plastic, a polyethylene, a recyclable material, and a recycled material.

7. A collar support strap to provide support for a shirt collar in a packaged form, the collar support strap comprising:

a substantially flat body comprising two halves at a predefined angle;

a first locking mechanism comprising a first tongue piece protruding from a distal edge of one of the two halves and a plurality of grooves along another one of the two halves;

a second locking mechanism within the body of the collar support strap when the collar support strap is in an unfolded condition, wherein the second locking mechanism comprises a second tongue piece and a cutout around the second tongue piece to push the second tongue piece into another selected groove of the plurality of grooves, wherein the second tongue piece is positioned between the first tongue piece and the plurality of grooves when the collar support strap is in the unfolded condition; and a cutout at an apex of the body connecting the two halves, the cutout configured to anchor the collar support strap to a collar button of the shirt collar.

8. The collar support strap of claim 7, wherein the collar support strap is configured to be placed between a collar band and the shirt collar in the packaged form.

9. The collar support strap of claim 8, wherein the collar support strap is substantially invisible when the shirt collar is folded over the collar support strap in the packaged form.

10. The collar support strap of claim 7, wherein a width of the collar support strap is selectable based on a collar height.

11. The collar support strap of claim 7, wherein the predefined angle of the collar support strap is selectable based on a collar type.

12. The collar support strap of claim 7, wherein a length of the collar support strap is adjustable through selection of a proper groove of the plurality of grooves based on a shirt collar size and locking of the tongue piece into the selected groove.

13. The collar support strap of claim 7, further comprising:

two protrusions from the body of the collar support strap in a vicinity of the cutout to provide support for collar points in the packaged form.

14. The collar support strap of claim 13, wherein a size and a depth of the two protrusions are selectable based on a size of the collar points.

15. The collar support strap of claim 7, wherein the collar support strap is made from a material comprising one or more from the list of a paper, a cardboard, a plastic, a polyethylene, a recyclable material, and a recycled material.

16. A collar support strap to provide support for a shirt collar in a packaged form, the collar support strap comprising:

a substantially flat body comprising two halves at a predefined angle;

a first locking mechanism comprising a first tongue piece protruding from a distal edge of one of the two halves and a plurality of grooves along another one of the two halves;

a second locking mechanism within the body of the collar support strap when the collar support strap is in an unfolded condition, wherein the second locking mechanism comprises a second tongue piece and a cutout around the second tongue piece to push the second tongue piece into another selected groove, wherein the second tongue piece is positioned between the first tongue piece and the plurality of grooves when the collar support strap is in the unfolded condition;

a cutout at an apex of the body connecting the two halves, the cutout configured to anchor the collar support strap to a collar button of the shirt collar; and two protrusions from the body of the collar support strap in a vicinity of the cutout to provide support for collar points in the packaged form.

* * * * *